United States Patent [19]

Brewster

[11] 4,038,653

[45] July 26, 1977

[54] TRAIN POSITION INDICATOR

[75] Inventor: Arthur Edward Brewster, Thaxted, England

[73] Assignee: International Standard Electric Corporation, New York, N.Y.

[21] Appl. No.: 667,327

[22] Filed: Mar. 16, 1976

[51] Int. Cl.[2] ..... B61L 25/00; G01S 9/56

[52] U.S. Cl. ..... 343/6.8 R; 246/63 R; 246/122 R; 343/6 R; 343/6.5 SS; 340/38 L; 340/47

[58] Field of Search ..... 343/6.5 SS, 6 R, 6.8 R; 340/258 C, 47, 23, 38 L; 246/122 R, 63 R, 63 A

[56] References Cited

U.S. PATENT DOCUMENTS

| | | | |
|---|---|---|---|
| 3,142,836 | 7/1964 | Ambrose | 343/6.8 R |
| 3,290,675 | 12/1966 | Neild | 343/6.5 SS |
| 3,299,424 | 1/1967 | Vinding | 343/6.5 SS |
| 3,543,056 | 11/1970 | Klein | 340/258 C |
| 3,888,437 | 6/1975 | Birkin | 246/63 A |

*Primary Examiner*—Maynard R. Wilbur
*Assistant Examiner*—Lawrence Goodwin
*Attorney, Agent, or Firm*—John T. O'Halloran; Alfred C. Hill

[57] ABSTRACT

A low power radar mounted on the train interrogates passive transponders located along the track. Inductive coupling arrangements associated with the radar and each of the transponders inhibits responses from transponders other than the one immediately underneath the radar, and also for indicating failure of transponders.

6 Claims, 1 Drawing Figure

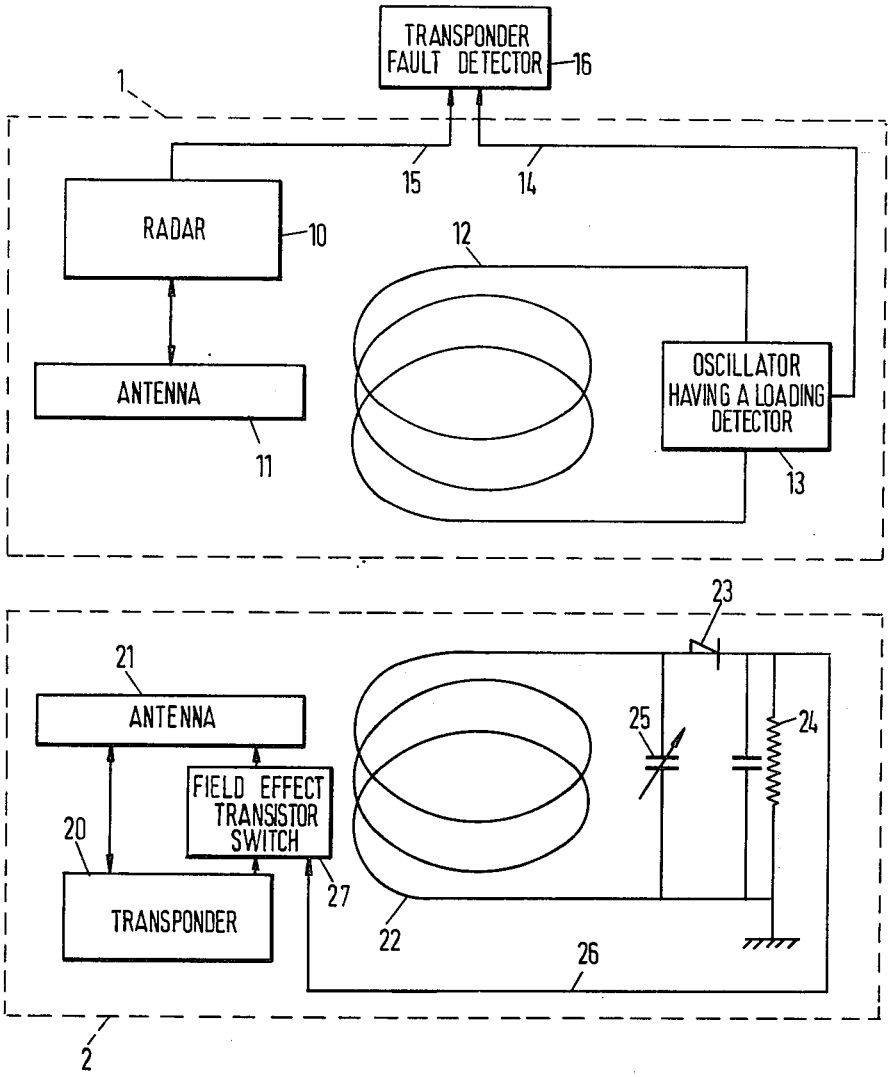
TRANSPONDER FAULT DETECTOR
16
1
15
14
RADAR
10
12
ANTENNA
11
OSCILLATOR HAVING A LOADING DETECTOR
13
23
21
ANTENNA
25
24
FIELD EFFECT TRANSISTOR SWITCH
20
27
TRANSPONDER
22
26
2

TRAIN POSITION INDICATOR

BACKGROUND OF THE INVENTION

This invention relates to a train position indicating system.

In the co-pending U.S. patent application of P. K. Blair, Ser. No. 618,184, filed Sept. 30, 1975 having the same assignee as the present application, there is described a train position indicating system in which a low power radar is used to interrogate simple transponders moving relative to the radar. The transponders may be made to transmit different responses or even complex responses to give a code identifying the transponder and indicating the state of a signal or other equipment to which the transponder relates.

In one application it was envisaged that the radar would be mounted underneath a train and passive transponders would be mounted between the rails. The transponders could be spaced at distances of as little as 5 meters in some cases. Such a situation might give rise to problems in as much as the radar interrogation might trigger responses from several transponders simultaneously, with consequential mutual interference.

SUMMARY OF THE INVENTION

An object of the present invention is to provide a train position indicating system of the type described above in which only the transponder immediately underneath the radar will respond.

A feature of the present invention is the provision of a train position indicating system comprising: a radar disposed in the train; a first inductive coupling means disposed adjacent the radar; a plurality of transponders disposed in spaced relation along a track upon which the train runs; a plurality of second inductive coupling means each disposed adjacent a different one of the plurality of transponders; first means coupled to the first inductive coupling means to energize the first inductive coupling means; and a plurality of second means each coupled to a different one of the plurality of second inductive coupling means responsive to an inductively coupled signal from the first inductive coupling means to enable an associated one of the plurality of transponders to respond to a radar interrogation signal, the others of the plurality of transponders being inhibited from responding to the radar interrogation signal due to the absence of the inductively coupled signal.

In a preferred embodiment of the invention each of the plurality of second means includes third means for rectifying electrical currents induced into the associated one of the plurality of second inductive coupling means and switching means responsive to the presence of the rectified currents to control the radar response of an associated one of the plurality of transponders.

BRIEF DESCRIPTION OF THE DRAWING

The above-mentioned and other features and objects of this invention and the manner of obtaining them will become more apparent by reference to the following description taken in conjunction with the drawing, the single FIGURE of which illustrates a preferred embodiment of this invention.

DESCRIPTION OF THE PREFERRED EMBODIMENT

In the drawing the train mounted equipment is generally designated 1 and the track mounted equipment is designated 2. The train mounted equipment comprises a low power radar 10 which is coupled to a transmit/-receive antenna 11 mounted on the underside of the train. Adjacent the antenna 11 is an inductive coupling loop 12 which is energized by a continuous sinusoidal signal from oscillator 13, typically at a frequency of 100 kHz (kilohertz).

The track mounted equipment comprises a transponder 20 coupled to its receive/transmit antenna 21. Adjacent the antenna 21 is an inductive coupling loop 22. The positioning of the loops 12 and 22 relative to the antennas 11 and 21 respectively is such that mutual coupling between the loops occurs only when the train antenna 11 is substantially above the track antenna 21. The track loop 22 is coupled to a rectifying circuit including rectifier 23, RC network 24 and tuning capacitor 25. This circuit provides a d.c. (direct current) output signal when mutual coupling between the loops 12 and 22 occurs. The d.c. signal is fed via line 26 to the field effect transistor switch 27. Switch 27 is responsive to the d.c. signal such that in the absence of the d.c. signal the transponder is disabled and in the presence of the d.c. signal it is enabled.

When loop 12 is substantially above loop 22 no significant coupling should occur with track mounted loops for adjacent transponders, even as close as 5 meters. The other transponders, lacking sufficient inductive coupling to produce an adequate d.c. signal would remain disabled and therefore unresponsive to interrogation from the train mounted radar.

Furthermore, the presence of a transponder loop in maximum coupling with the train mounted loop would result in increased loading of the energizing oscillator 13. This increase in loading can be detected by a loading detector in oscillator 13 and made to generate a signal on line 14 indicative of the presence of a transponder, or its passage, under the radar. This signal can be used in conjunction with the radar output on line 15 to confirm, in the transponder and fault detector 16, such as an AND gate, in the train position equipment, the passage of the transponder under the radar. In addition, the AND gate, could be made to actuate an alarm indication due to no output from the AND gate in the event that a transponder passing under the radar were detected by the increased loading of oscillator 13 and a signal on line 14 but no radar response code had been received resulting in no signal on line 15.

While I have described above the principles of my invention in connection with specific apparatus it is to be clearly understood that this description is made only by way of example and not as a limitation to the scope of my invention as set forth in the objects thereof and in the accompanying claims.

I claim:

1. A train position indicating system comprising:

a radar disposed in said train;

a first inductive coupling means disposed adjacent said radar in said train;

a plurality of transponders disposed in spaced relation along a track upon which said train runs;

a plurality of second inductive coupling means each disposed adjacent a different one of said plurality of transponders;

first means coupled to said first inductive coupling means to energize said first inductive coupling means; and a plurality of second means each coupled to a different one of said plurality of second inductive coupling means responsive to an inductively coupled signal from said first inductive coupling means to enable an associated one of said plurality of transponders to respond to a radar interrogation signal, the others of said plurality of transponders being inhibited from responding to said radar interrogation signal due to the absence of said inductively coupled signal.

2. A system according to claim 1, wherein each of said plurality of second means includes third means for rectifying electrical currents induced into the associated one of said plurality of second inductive coupling means, and switching means coupled to an associated one of said plurality of transponders and said third means responsive to said rectified currents to control the radar response of an associated one of said plurality of transponders.

3. A system according to claim 2, wherein each of said switching means includes a field effect transistor coupled between an associated one of said plurality of transponders and an associated receive/transmit antenna.

4. A system according to claim 3, further including fourth means coupled to said first means to detect an increased loading on said first means; and fifth means coupled to said radar and said fourth means to give an alarm indication when an increased loading is detected and no concurrent radar response is received from an associated one of said plurality of transponders.

5. A system according to claim 2, further including fourth means coupled to said first means to detect an increased loading on said first means; and fifth means coupled to said radar and said fourth means to give an alarm indication when an increased loading is detected and no concurrent radar response is received from an associated one of said plurality of transponders.

6. A system according to claim 1, further including third means coupled to said first means to detect an increased loading on said first means; and fourth means coupled to said radar and said third means to give an alarm indication when an increased loading is detected and no concurrent radar response is received from an associated one of said plurality of transponders.

* * * * *